US009814930B2

(12) United States Patent
Manzke et al.

(10) Patent No.: US 9,814,930 B2
(45) Date of Patent: Nov. 14, 2017

(54) EXERCISE APPARATUS

(71) Applicant: JOHNSON HEALTH TECH CO., LTD, Taichung (TW)

(72) Inventors: Russell C. Manzke, Taichung (TW); Ryan Francis Crist, Taichung (TW)

(73) Assignee: JOHNSON HEALTH TECH CO., LTD., Daya District, Taichung (TW)

( * ) Notice: Subject to any disclaimer, the term of this patent is extended or adjusted under 35 U.S.C. 154(b) by 0 days.

(21) Appl. No.: 14/925,682

(22) Filed: Oct. 28, 2015

(65) Prior Publication Data

US 2016/0346598 A1 Dec. 1, 2016

Related U.S. Application Data

(63) Continuation-in-part of application No. 14/726,622, filed on Jun. 1, 2015.

(51) Int. Cl.
*A63B 21/00* (2006.01)
*A63B 21/005* (2006.01)
(Continued)

(52) U.S. Cl.
CPC ..... *A63B 22/02* (2013.01); *A63B 22/0023* (2013.01); *A63B 23/047* (2013.01);
(Continued)

(58) Field of Classification Search
CPC ..... A63B 21/00058; A63B 21/00069; A63B 21/0076; A63B 21/00192; A63B 21/005; A63B 21/0051; A63B 21/0052; A63B 21/0056; A63B 21/012; A63B 21/0125; A63B 21/015; A63B 21/22; A63B 21/225; A63B 21/227; A63B 21/4033; A63B 21/4034; A63B 21/4035; A63B 22/02; A63B 22/0235; A63B 22/0242; A63B 22/025; A63B 22/0257; A63B 23/04; A63B 23/0405; A63B 23/047; A63B 23/0482; A63B 23/0494; A63B 24/0087; A63B 2024/0093; A63B 69/0028;
(Continued)

(56) References Cited

U.S. PATENT DOCUMENTS 4,323,237 A * 4/1982 Jungerwirth ..... A63B 21/154 482/119
4,470,597 A * 9/1984 McFee ..... A63B 22/0056 482/110
(Continued)

*Primary Examiner* — Loan H Thanh
*Assistant Examiner* — Gary D Urbiel Goldner
(74) *Attorney, Agent, or Firm* — Michael Best & Friedrich LLP

(57) ABSTRACT

An exercise apparatus includes a platform having a front roller, a rear roller and an endless belt mounted around the front roller and the rear roller for allowing a user to perform walking, jogging or running exercises on the belt. A flywheel is coupled to one of the two rollers. A friction resistance device is coupled to the flywheel for being manually controlled by the user to adjust rotational resistance of the flywheel, and a magnetic resistance device is coupled to the flywheel as well for being manually controlled by the user to adjust the rotational resistance of the flywheel. A front frame is mounted at a front side of the platform and has at least one holding portion for being held by the user.

10 Claims, 12 Drawing Sheets

(51) Int. Cl.

| | |
|---|---|
| ***A63B 21/015*** | (2006.01) |
| ***A63B 21/02*** | (2006.01) |
| ***A63B 21/04*** | (2006.01) |
| ***A63B 21/055*** | (2006.01) |
| ***A63B 21/22*** | (2006.01) |
| ***A63B 22/00*** | (2006.01) |
| ***A63B 22/02*** | (2006.01) |
| ***A63B 23/04*** | (2006.01) |
| ***A63B 69/00*** | (2006.01) |
| ***A63B 71/00*** | (2006.01) |

(52) U.S. Cl.
CPC ..... *A63B 69/0057* (2013.01); *A63B 21/0051* (2013.01); *A63B 21/00069* (2013.01); *A63B 21/015* (2013.01); *A63B 21/023* (2013.01); *A63B 21/0414* (2013.01); *A63B 21/0552* (2013.01); *A63B 21/225* (2013.01); *A63B 22/0242* (2013.01); *A63B 2071/009* (2013.01); *A63B 2209/08* (2013.01); *A63B 2225/093* (2013.01)

(58) Field of Classification Search
CPC ..... A63B 69/0035; A63B 69/0057; A63B 71/0054; A63B 71/0619; A63B 2071/0063; A63B 2071/0072; A63B 2071/0081; A63B 2071/009; A63B 2071/0675; A63B 2071/0694; A63B 2208/0204; A63B 2209/08; A63B 2225/09
See application file for complete search history.

(56) References Cited

U.S. PATENT DOCUMENTS 4,659,074 A * 4/1987 Taitel ..... A63B 21/015 188/187
4,659,077 A * 4/1987 Stropkay ..... A63B 21/018 482/120
4,890,495 A * 1/1990 Slane ..... A63B 21/154 482/51
5,409,435 A * 4/1995 Daniels ..... A63B 21/00845 482/5
5,728,029 A * 3/1998 Minoura ..... A63B 21/0051 482/61
6,042,514 A * 3/2000 Abelbeck ..... A63B 22/02 198/439
6,387,015 B1 * 5/2002 Watson ..... A63B 21/15 482/103
7,575,537 B2 * 8/2009 Ellis ..... A63B 21/00076 482/5
7,833,133 B2 * 11/2010 Stewart ..... A63B 22/001 482/52
8,343,016 B1 1/2013 Astilean
2003/0013584 A1 * 1/2003 Harney ..... A63B 22/02 482/54
2004/0087418 A1 * 5/2004 Eldridge ..... A63B 21/157 482/54
2007/0123395 A1 * 5/2007 Ellis ..... A63B 21/154 482/54
2007/0123396 A1 * 5/2007 Ellis ..... A63B 21/0618 482/54
2007/0167295 A1 * 7/2007 Chen ..... A63B 21/0051 482/63
2009/0137367 A1 * 5/2009 Hendrickson ..... A63B 21/0051 482/54
2009/0298649 A1 * 12/2009 Dyer ..... A63B 22/001 482/4
2011/0082011 A1 * 4/2011 Ellis ..... A63B 21/0615 482/54
2011/0118090 A1 * 5/2011 Ellis ..... A63B 21/4047 482/54
2011/0281691 A1 * 11/2011 Ellis ..... A63B 22/0012 482/54
2012/0010048 A1 * 1/2012 Bayerlein ..... A63B 21/0053 482/2
2012/0322624 A1 * 12/2012 Wu ..... A63B 22/203 482/52
2013/0172153 A1 * 7/2013 Watterson ..... A63B 21/4035 482/5
2014/0141939 A1 * 5/2014 Wu ..... A63B 22/001 482/52
2014/0274578 A1 9/2014 Kennedy
2016/0243396 A1 * 8/2016 Taylor ..... A63B 21/4049

* cited by examiner

EXERCISE APPARATUS

CROSS-REFERENCE TO RELATED APPLICATION

This is a continuation-in-part of application Ser. No. 14/726,622, filed on Jun. 1, 2015.

BACKGROUND

1. Field of the Invention

The present invention relates to an exercise apparatus. More particularly, the present invention relates to a treadmill.

2. Description of the Related Art

Most treadmills are electrically powered. In operation, the endless belt on the platform of the treadmills is powered by a motor at a predetermined speed for allowing a user to walk, jog or run on the belt. Generally, electric treadmill users can preset a program containing timing variation before exercise so that the treadmill will automatically make the speed of the treadmill become faster or slower at a predetermined point according to the aforementioned program during exercise. Additionally, during exercise, the user could direct the belt to speed up or slow down through a control interface of the treadmill for allowing the user to adjust the exercising speed or change exercise modes (e.g. from walking to jogging). Even so, for the operation of the electric treadmill, it requires the user to walk or run at a speed matching that of the belt, rather than the speed of the belt matching the speed of the user. In short, users cannot immediately speed up or slow down the speed of walking, jogging or running on the electric treadmill like outdoor exercise whenever they want to.

In general, the electric treadmills are usually used for a long period of walking or running (e.g. 20, 30 minutes or more). Moreover, in current commercial treadmills, the upper limit of the adjusting range of the belt running speed is actually up to 24 to 27 km/h, that is equal to one hundred meters just in 13~14 seconds and suitable for a short period of fast-run or sprint. Since everyone has different physical abilities, not all fast-runs or sprints are carried out under maximum-speed operation of the belt. No matter how fast the belt is, when the user performs sprint exercises on the treadmill, the belt is driven by the motor at high speed. Therefore, if the user's running speed cannot keep up with the belt speed, an accident may occur. Furthermore, if the user wants to take a break or end the exercise during the sprint exercise, the user usually has two hands grip two side handrails first, and then has two feet span the belt on two side rails. If the user wants to continue running after the break, the user would step on the belt again and keep up with the belt speed, and then the user could take the two hands off the two side rails for free swinging. It is obvious that the aforementioned motions of the break and the continuance of running have a certain degree of difficulty and danger. For the safety reason, maybe that is why many people never adjust the belt speed up to the high-speed region, even if they are able to sprint with equal speed for a short time on the ground.

Relative to the electric treadmills, nowadays there are some treadmills without electric power in the market. Rather than being powered by an electric motor, the belt is powered by the user when the user walks or runs on the treadmill to push the belt with two feet (further supplemented by inertial force of a flywheel). Generally speaking, since the belt of the non-electric treadmill is rotated with the motion of the user's two feet, the user could speed up or slow down the speed of walking, jogging or running anytime. However, the general non-electric treadmill is not suitable for sprinting. The reason is that: if a user continues to increase the running speed, the forward speed corresponding to the running motion of the user (equal to the step length multiplied by step frequency) may run faster than the sliding speed to the rear of the belt plane such that the user would be close to the front end of the treadmill. In order to keep running in an appropriate region of the belt, users will naturally restrain their running speed and thus the maximum capacity cannot be exerted, so that the desired training effect cannot be achieved.

There is one method in existence trying to solve the above problems, that is, to provide a wearing member attached to the waist or the upper body of the user, e.g. an endless strap that is able to put around the waist or the abdomen of the user, or a vest being able to be worn on the user's body. Moreover, an appropriate length of rope is connected between the wearing member and a holder fixed behind the platform. Thereby, when the user who wears the wearing member exercises on the non-electric treadmill, if the body moves forward to a predetermined position, the body will be pulled by the rope in the rear side (straightened) to restrict the further forward motion of the user. Therefore, the user could practice for quick running or sprint with normal running motion, and to freely slow down or accelerate again in the process of running. There is a disadvantage in the aforementioned method. It requires the user to wear the wearing member before the user exercises on the platform of the treadmill. For example, the user needs to put the endless strap around the waist, and to take off the wearing member from the body after the end of the exercise. It is bothersome for the user. Furthermore, since it needs to install a stationary frame for securing the rear end of the rope behind the platform, the whole device will occupy more space.

On the other hand, the treadmills are generally available only for aerobic exercises of walking, jogging or running, such functions are restricted. One type of exercise apparatus with both functions of treadmill and weight training is shown in U.S. Publication No. 2014/0274578 A1. The exercise apparatus includes a platform of an analogous non-electric treadmill. The platform has a flywheel axially mounted on one end of the front roller and a friction resistance device disposed beside the flywheel. The user can manually adjust the tightness of the resistance device through a knob driving an arcuate brake pad to press against the peripheral surface of the flywheel so as to adjust the rotational resistance of the flywheel and the front roller, namely adjusting the running resistance of the belt. In addition to walking, jogging or running, the user can adjust the resistance to a higher level for making the belt difficult to slide. Then, the user could hold the front handle with two hands, adopting a position with low center of gravity, and pushing the belt backward with two legs so as to simulate a training of pushing a weight forward on the ground (e.g. push sled). As general non-electric treadmills, while walking, jogging or running on the exercise apparatus, the belt needs to have an appropriate resistance depending on the usage condition. However, the friction resistance device is not easy to adjust the resistance to meet the requirement especially for low resistance. If change to an eddy current type resistance device, it is relatively easy to make fine adjustment, but it may not be able to provide high resistance for the weight training.

The present invention has arisen to mitigate and/or obviate the disadvantages of the conventional method. Further benefits and advantages of the present invention will become apparent after a careful reading of the detailed description with appropriate reference to the accompanying drawings.

SUMMARY

The object of the present invention provides a non-electric treadmill for allowing a user to perform walking, jogging or running exercises, and perform a weight training that simulates a motion of pushing a weight forward. Furthermore, whether the user performs walking, jogging, running exercises or the weight training, the user can easily adjust the exercise resistance to meet the requirement of the user.

Another object of the present invention provides an exercise apparatus with two operation modes, for allowing the user to choose to perform the first type exercise under the first operation mode, or choose to perform the second type exercise under the second operation mode. The exercising movement of the second type exercise differs from the first type exercise, and the exercise resistance of the second type exercise is higher than the exercise resistance of the first type exercise. Furthermore, whether the user performs the first type exercise or the second type exercise, the user can easily adjust the exercise resistance to meet the requirement of the user.

According to one aspect of the present invention, the exercise apparatus includes: a platform having a front roller, a rear roller and an endless belt mounted around the front roller and the rear roller for allowing a user to perform walking, jogging or running exercises on the belt, such exercises causing the belt to revolve with the rollers; a flywheel coaxially connected to the front roller; a friction resistance device mounted beside the flywheel for allowing the user to control the rotational resistance of the flywheel and the front roller; an eddy current resistance device also mounted beside the flywheel for allowing the user to control the rotational resistance of the flywheel and the front roller; and a front frame secured to the front end of the platform, and having at least one holding portion for a user to grasp. Under this arrangement, when the user chooses to perform walking, jogging or running exercises, the user can control the eddy current resistance device to generate a relatively lower exercise resistance as necessary. In contrast, when the user chooses to perform the weight training that simulates a motion of pushing a weight forward, the user can control the friction resistance device to generate a relatively higher exercise resistance.

According to another aspect of the present invention, the exercise apparatus comprises: a frame; a moving member movably mounted to the frame, the first type exercise and the second type exercise shall power the moving member; a first resistance device being controllable to apply a first drag force to the moving member; a second type resistance device being controllable to apply a second drag force to the moving member, and the second drag force generated by the second resistance device being higher than the first drag force generated by the first resistance device; a first control interface connected to the first resistance device, for allowing the user to manually control the first resistance device to increase or decrease the first drag force applied to the moving member, the first control interface having at least one first symbol including a human figure showing a posture as performing the first type exercise; and a second control interface connected to the second resistance device, for allowing the user to manually control the second resistance device to increase or decrease the second drag force applied to the moving member, the second control interface having at least one second symbol including a human figure showing a posture as performing the second type exercise. Specifically, a resistance of the moving member for performing the second type exercise is higher than that for performing the first type exercise.

The reader is advised that this summary is not meant to be exhaustive. Further features, aspects, and advantages of the present invention will become better understood with reference to the following description, accompanying drawings and appended claims.

Further benefits and advantages of the present invention will become apparent after a careful reading of the detailed description with appropriate reference to the accompanying drawings.

DETAIL DESCRIPTION

Figure 1:
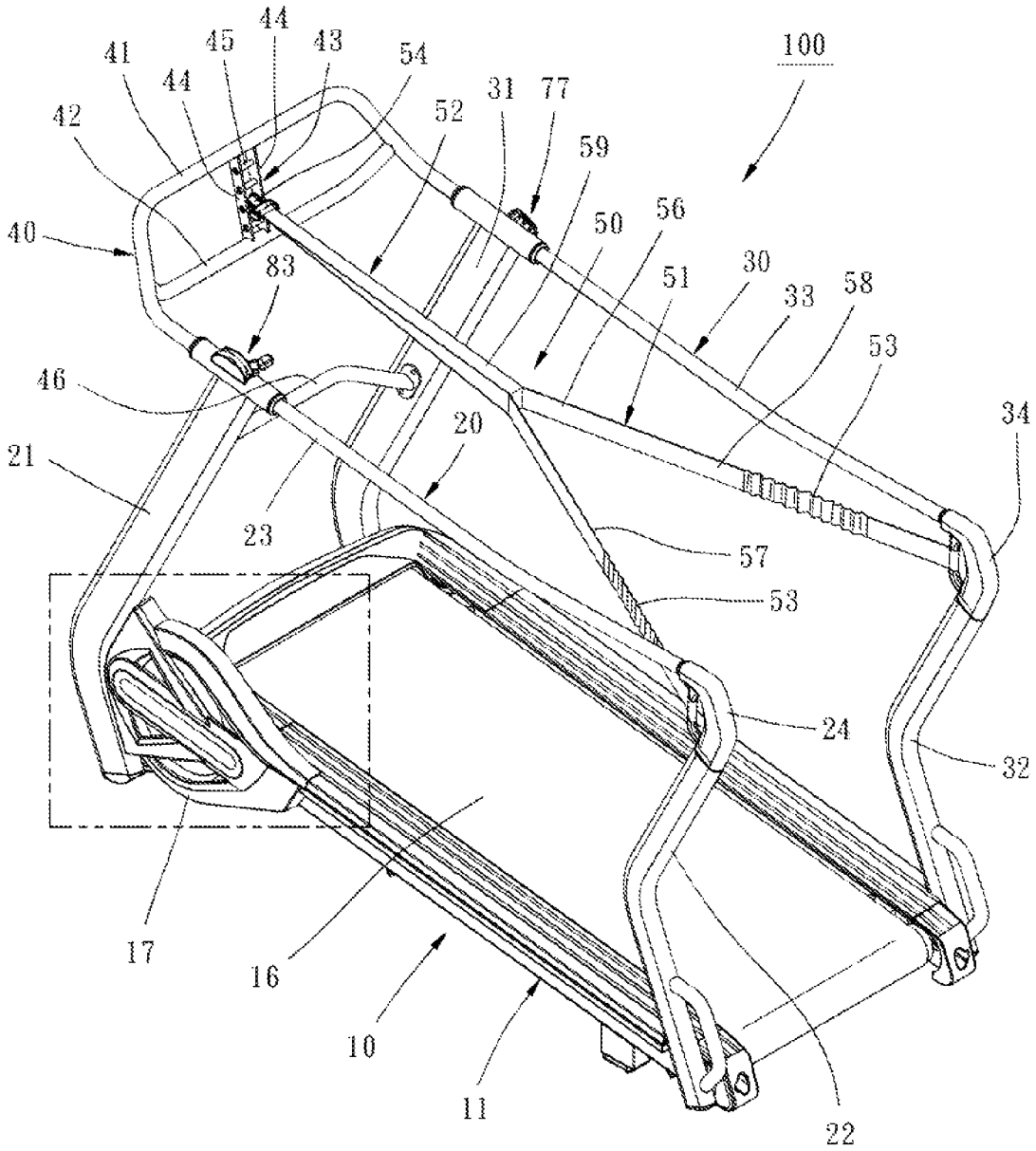
FIG. 1 is a perspective view of an exercise apparatus in accordance with a preferred embodiment of the present invention in a first operation mode, showing an unoccupied state.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Referring to FIGS. 1 through 4, there are shown a perspective view, a front, a top view and a side sectional view of an exercise apparatus 100 in the same state according to a preferred embodiment of the present invention. The exercise apparatus 100 includes a platform 10 resting on the ground, a left side frame 20 fixed on the left side of the platform 10, a right side frame 30 fixed on the right side of the platform 10, a front frame 40 fixed on the front end of the platform 10 and a restricting device 50 connected among the left side frame 20, the right side frame 30 and the front frame 40.

Figure 4:
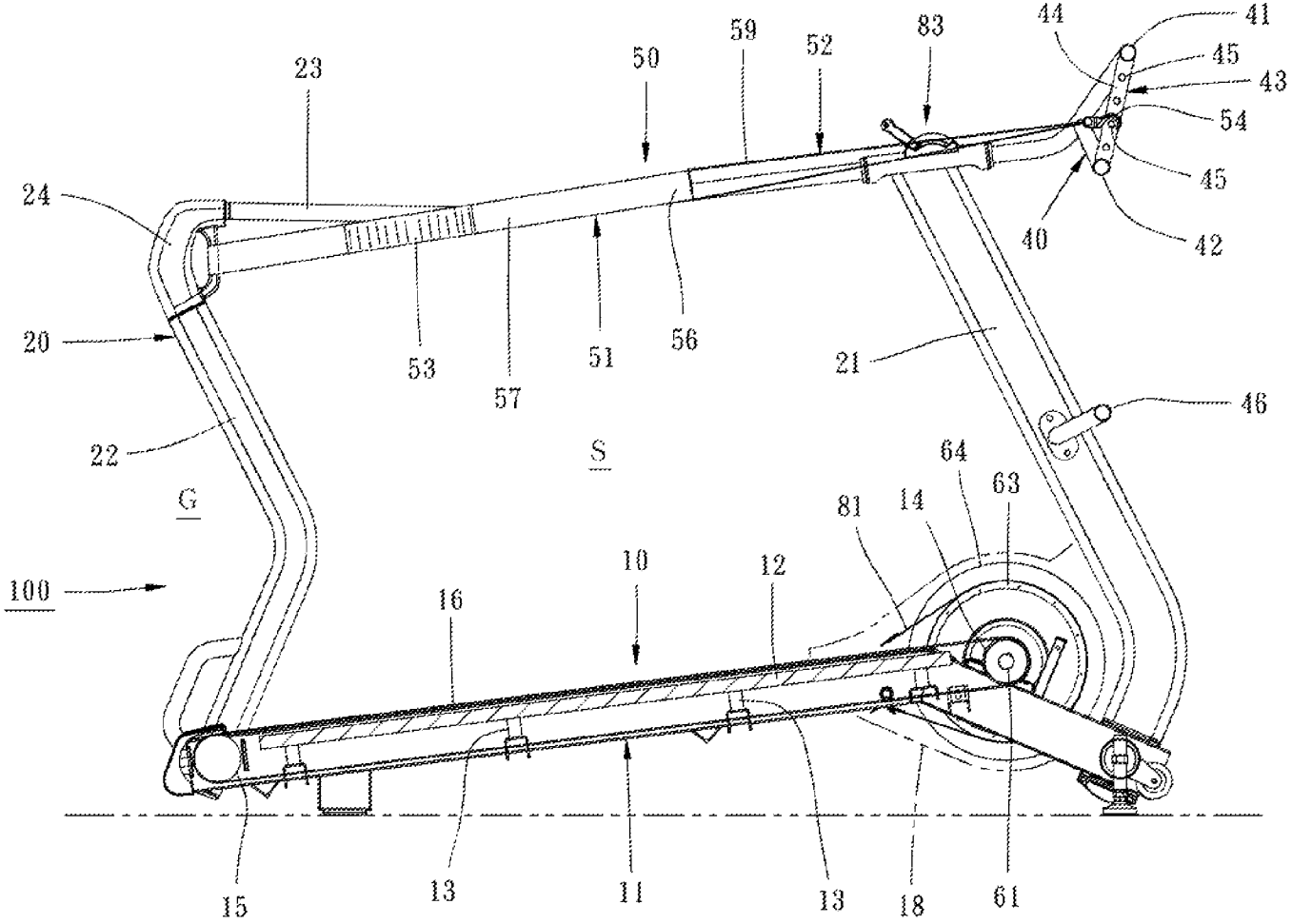
FIG. 4 is a cross-sectional view of the exercise apparatus along line IV-IV of FIG. 3, wherein parts of the outer shell are removed for showing the internal mechanism.

In the preferred embodiment of the present invention, the configuration of the platform 10 is similar to the platform of the conventional non-electric treadmill. As shown in FIG. 4, the platform 10 has a support frame 11 resting firmly on the ground. A deck 12 is supported on the support frame 11 through a plurality of elastic support members 13, wherein the front end of the deck 12 is higher than the rear end of the deck 12 (in the present embodiment, the elevation angle of the deck 12 relative to the ground is about 7 degrees). A front roller 14 is rotationally mounted on the support frame 11 in front of the deck 12 and a rear roller 15 is rotationally mounted on the support frame 11 at the rear of the deck 12. An endless belt 16 is mounted around the front roller 14 and the rear roller 15 across the top and the bottom of the deck 12 so as to provide a circular plane for a user to exercise thereon. In addition to the above common type platform, the platform of the present invention can also make use of a configuration as disclosed by the U.S. Pat. No. 8,343,016, that is, a platform without the deck. Alternatively, there are a plurality of rollers arranged along a left side and a right side of a treadmill frame in a longitudinal direction, and an endless belt comprises a plurality of parallel slates attached to each other. The left and right sides of the endless belt are available to slide on the rollers so that the endless belt could rotate around the treadmill frame and bear the user via the top plane of the belt. In short, the platform 10 is provided for allowing the user to perform walking, jogging or running on the endless belt 16, such exercises would promote the rotational motion of the belt 16. A flywheel 63 is coupled to the front roller 14. In the preferred embodiment, the flywheel 63 is coaxially mounted on the left end of the front roller 14. In addition to generate movement resistance, the inertial force produced by the rotation of the flywheel 63 also assists the revolution of the belt 16. The belt 16 defines an exercising space S above a top plane thereof (note: the space could be regard as a cuboid, the length and width of the space respectively correspond to the length and width of the top plane of the belt 16, and its height is substantially the average height of general persons). Like the exercise apparatus 100, the exercising space S defines a front side, a rear side, a left side and a right side corresponding to front, rear, left and right directions of the user.

Figure 5:
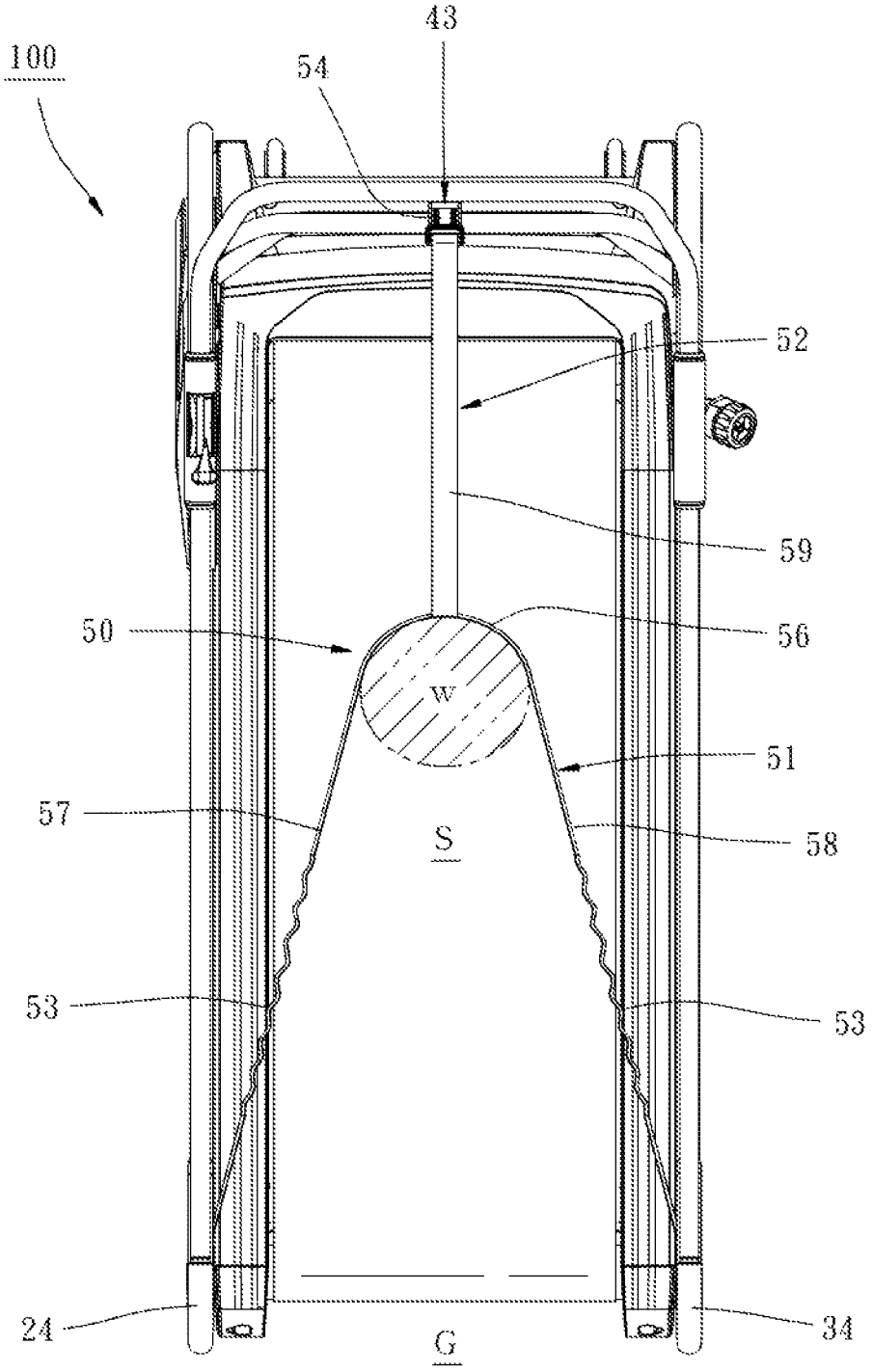
FIG. 5 is similar to FIG. 3, but illustrates a state that a user is doing running exercise.

The left side frame 20 and the right side frame 30 are respectively located at the left side and right side of the space S, and both have a front post 21, 31, a rear post 22, 32 and a handrail 23, 33. The bottom of the left and right side front posts 21, 31 are respectively secured to the left front corner and the right front corner of the support frame 11 of the platform 10. The bottom of the left and right rear posts 22, 32 are respectively secured to the left rear corner and the right rear corner of the support frame 11. The left and right side handrails 23, 33 are respectively connected between the top of the front post 21, 31 and the top of the rear post 22, 32 at the left and right sides and substantially extend parallel along the longitudinal direction of the platform 10. The height of each handrail 23, 33 (from the top plane of the belt 16) substantially corresponds to the waist height of general persons, for example 90 to 95 cm, it is available for a user to hold, if necessary. In the rear end of the exercise apparatus 100, there is an entrance G defined between the left and right rear posts 22, 32 for allowing the user to enter or exit from the exercising space S, as shown in FIGS. 4 and 5. The top end of each rear post 22, 32 and the rear end of the respective handrail 23, 33 are connected by a corner member. The corner member is configured to sustain the restricting device 50 as well. The left side corner member is defined as a left rear holding portion 24 at the left rear corner of the exercising space S, and the right side corner member is defined as a right rear holding portion 34 at the right rear corner of the exercising space S. The heights of the left rear holding portion 24 and the right rear holding portion 34 (from the top plane of the belt 16) substantially correspond to the waist height of the general persons.

The front frame 40 is connected between the top of the left and right side front posts 21, 31 and located at a front side of the exercising space S. The front frame 40 has an upper rail 41 and a lower rail 42 extending axially. A front holding portion 43 is connected between the upper rail 41 and the lower rail 42 at a central position of the front frame 40. The front holding portion 43 has two parallel longitudinal connecting plates 44 connected between the upper and lower rails 41, 42 and a plurality of horizontal rods 45 spaced apart in a distance between the two longitudinal connecting plates 44. The location of the horizontal rods 45 substantially corresponds to the waist height of the general users (from the top plane of the belt 16), wherein every adjacent two of the horizontal bars have a predetermined height difference therebetween.

The restricting device 50 includes a first strap 51 and a second strap 52. The first strap 51 defines a left end, a right end and a middle part therebetween. The left end and the right end of the first strap 51 is connected to the left rear holding portion 24 of the left side frame 20 and the right rear holding portion 34 of the right side frame 30 respectively. The middle part of the first strap 51 is located within the exercising space S and located in a central area between the left and right side frames 20, 30. The second strap 52 defines a front end connected to the front holding portion 43 of the front frame 40 and a rear end connected to the middle part of the first strap 51. Specifically, the first strap 51 comprises a plurality of tough straps (e.g. canvas bands, woven belt) sewn with elastic bands, and two ends are respectively wrapped in connection with vertical rods (not numbered) of the left rear holding portion 24 and the right rear holding portion 34 as the left and right end of the first strap 51. In addition, the first strap 51 is separated into left and right halves by the middle part, and each of the left and right halves has an elastic band 53 to form an elastic section which could be stretchable in a longitudinal direction. On the other hand, the second strap 52 is made of a tough strap. The tough strap is folded up and two ends of that are sewn together and connected to a hook 54. The hook 54 is detachably fastened on one of the horizontal rods 45 of the front holding portion 43 to form the front end of the second strap 52. The second strap 52 has the central portion of the aforementioned strap wrap around the middle part of the first strap 51 and sews together to from the rear end of the second strap 52.

Figure 2:
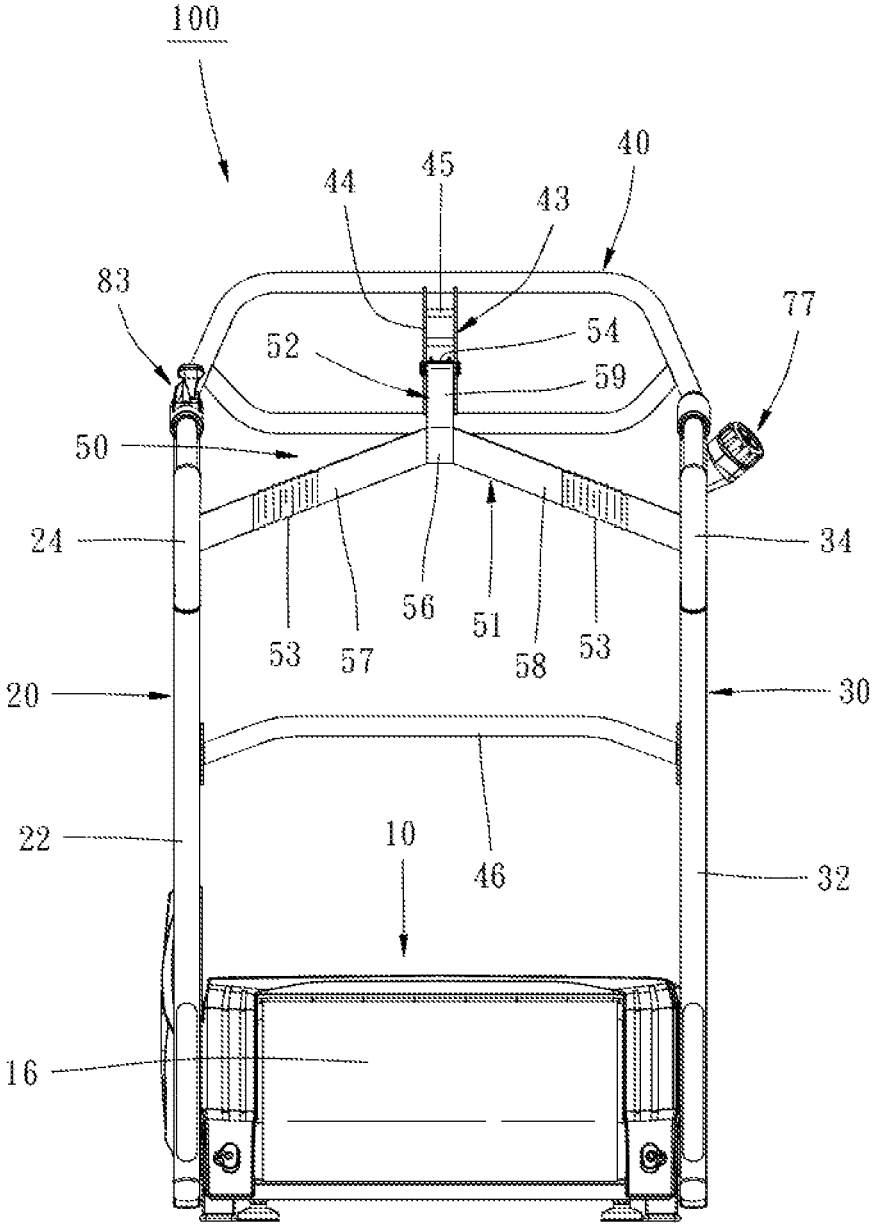
FIG. 2 is a front view of the exercise apparatus shown in FIG. 1.
Figure 3:
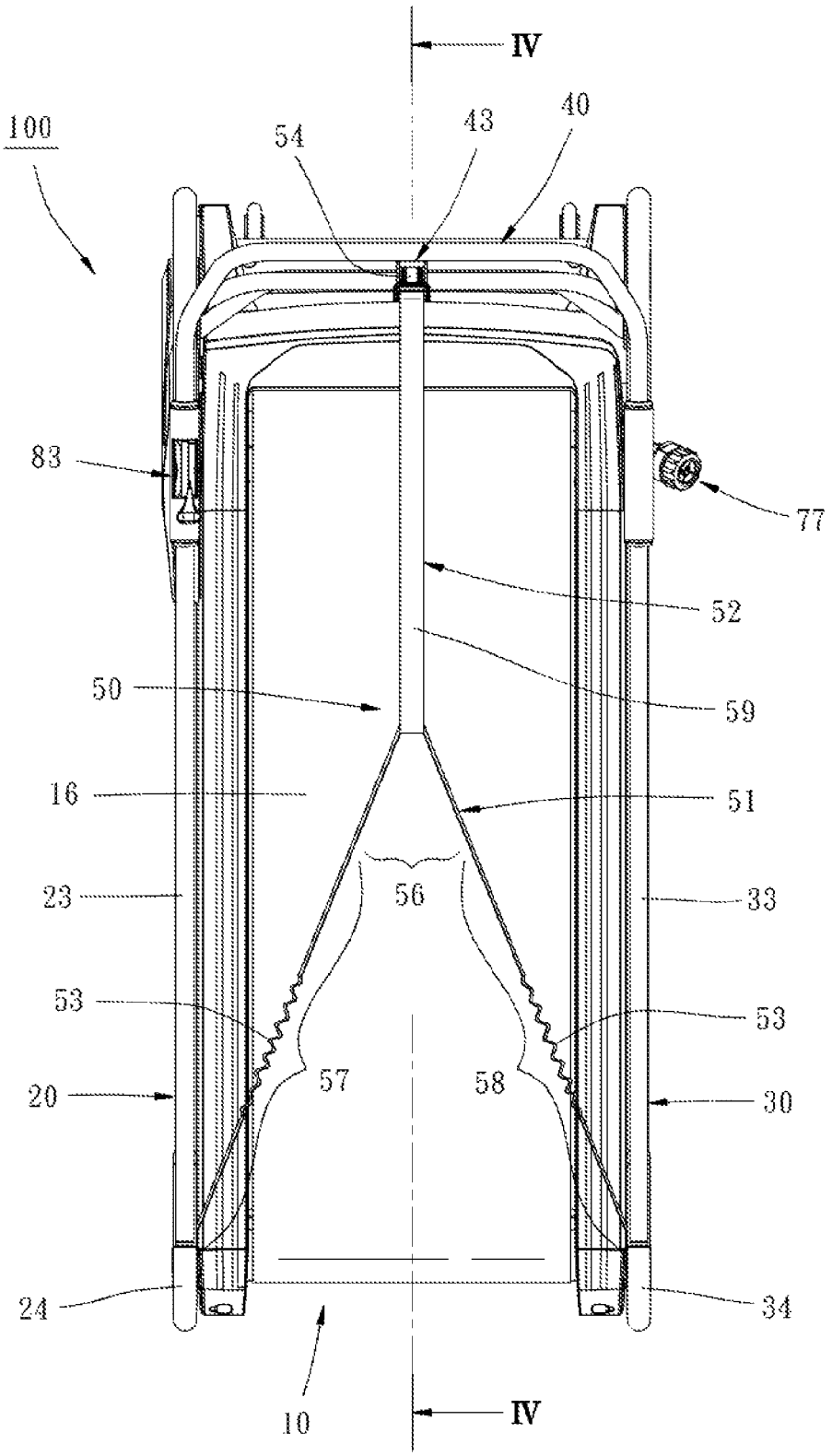
FIG. 3 is a top view of the exercise apparatus shown in FIG. 1.

As shown in FIGS. 1 through 3, the first strap 51 and the second strap 52 of the restricting device 50 is substantially Y-shaped with branch portion facing rearward (as an inverted Y shape) while the exercise apparatus 100 is unoccupied. For short, the left and right halves of the first strap 51 would be shortened by a recovery force of the elastic band 53, that is, the left half of the first strap 51 would pull the middle part toward the left rear direction and the right half of the first strap 51 would pull the middle part toward the right rear direction. Therefore, the first strap 51 will pull the rear end of the second strap 52 toward the rear direction by a symmetrical force of the left and right halves, so that the second strap 52 is stretched along the longitudinal direction. Under this arrangement, the elastic band 53 still has its elasticity, but it is unable to be shortened, thus the left and right halves of the first strap 51 are linearly extended respectively. The first strap 51 defines a local area around the middle part as a retaining portion 56 (note: the local area in FIG. 3 is schematically illustrated only, there may no clear boundary actually). The retaining portion 56 is generally V-shaped with an opening toward the rear side, it defines a left end and a right end. The first strap 51 defines a left restricting portion 57 between the left end and the retaining portion 56, showing that the left restricting portion 57 extends from left rear holding portion 24 toward a right front direction and connects to the left end of the retaining portion 56, and containing an elastic band (elastic section) 53 therebetween. The first strap 51 defines a right restricting portion 58 between the right end and the retaining portion 56, showing that the right restricting portion 58 extends from the right rear holding portion 34 toward a left front direction and connects to the right end of the retaining portion 56, and also containing an elastic band (elastic section) 53 therebetween. The whole of the second strap 52 is defined as a suspension portion 59 which extends rearward from the front holding portion 43 and connects to a central position of the retaining portion 45. All in all, the retaining portion 56 of the restricting device 50 is maintained at the central area of the exercising space S by the left restricting portion 57, the right restriction portion 58 and the suspension portion 59, and located at a corresponding height of a waist of the user.

Figure 6:
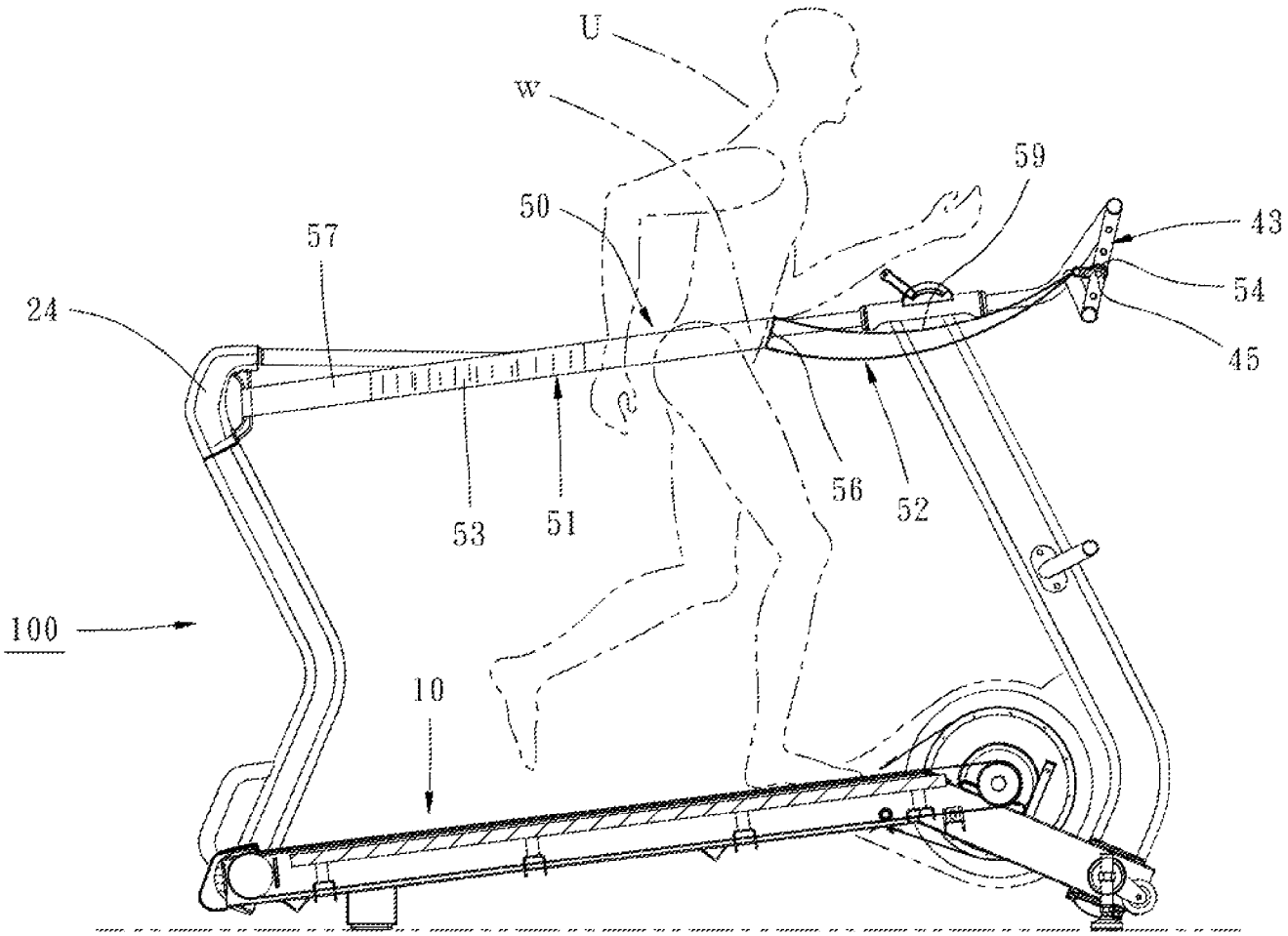
FIG. 6 is similar to FIG. 4, but illustrates the state that the user is doing running exercise.

Under this arrangement, when the user wants to perform walking, jogging or running on the exercise apparatus 100, the user can step onto the platform 10 through the entrance G at the rear end of the exercise apparatus 100 and go forward to the central area of the exercising space S freely. Generally, the retaining portion 56 of the restricting device 50 is kept at the height of the user's waist and substantially V-shaped with the opening toward the rear side. Therefore, when the user move forward to the central area of the exercising space S, the retaining portion 56 will naturally abut against the waist of the user and be deformed in accordance with the forward pressing degree of the user. For example, the retaining portion 56 would become arcuate to perfectly fit the front side, the left side and the right side of the waist of the user, and then the user could start walking, jogging or running in this state, as shown in FIG. 5 and FIG. 6. While exercising, especially at the time that the belt 16 is in the state of initial running or low speed, if the forward speed corresponding to the stepping motion of the user U is greater than the surface sliding speed of the belt 16, the user U will move forward toward the front side of the exercising space S. In other words, the retaining portion 56 of the restricting device 50 would be pushed by the waist W of the user U. Within a certain extent, the left restricting portion 57 and the right restricting portion 58 of the restricting device 50 are elongated through the elongational elasticity of the elastic band 53 till the elastic band 53 cannot be elongated anymore, and the suspension portion 59 will naturally hang down since the distance between the front and the rear end of the suspension portion 59 is shortened at the same time. Besides, the tension will increase while the elastic band 53 is elongated such that the pulling force of the left restricting portion 57 and the right restricting portion 58 for pulling the retaining portion 56 backward would be greater than the forward force of the user U, and therefore the waist W of the user U would be restricted by the retaining portion 56, thus the waist W of the user U is unable or difficult to move forward, that is, the user U cannot continue to move forward as a whole. When the waist W of the user U slightly backs from the position that the waist W of the user U is unable or difficult to move forward, the retaining portion 56 is maintained against the waist W of the user U and not falls to a low place because the retaining portion 56 is pulled by the left restricting portion 57 and the right restricting portion 58 with stretch elasticity all the time. By presetting the normal length and the maximum length of the left restricting portion 57 and the right restricting portion 58, the whole body of the user U is located in the central area or the central front location.

As the user is pulled by the rope to restrict the forward motion in the prior art, the present invention uses the restricting device 50 to retain the waist W of the user U for restrict the forward motion. In this manner, the user could run free without hands holding a front handrail, using a reaction force to increase the foot pushing force on the belt 16 for allowing the belt 16 beginning to slide easily from a rest condition and to keep running at a lower speed (in the walking motion). In addition, since the user U is unable to move forward relatively, the sliding speed of the surface of the belt 16 will fully reflect the foot motion of the user. Therefore, the user U can move naturally for walking, jogging or running just like outdoor sports and speed up or slow down the movement speed whenever they want to during the exercise. Besides, the revolution speed of the belt 16 is the speed at which the user U moves, so that the user U can continue to accelerate the running speed to sprint or quick run in the individual maximum capacity for high-strength training. When the exercise is finished, the user U is able to freely back away and leave the platform 10 through the entrance G. When the waist W of the user U is away from the retaining portion 56, the restricting device 50 will return to the original state. Compared to the prior art that the user is restricted by a rope on the rear side, in relation to the exercise apparatus 100 of the present invention, the user does not need to wear or take off the wearing member attaching to the end of the rope, it is convenient to use. Furthermore, because there is no need to set additional stationary frame for securing the rope behind the platform, the exercise apparatus 100 of the present invention occupies less space.

During the time that the user U walks, jogs or runs (including quick nm or sprint) on the exercise apparatus 100, the retaining portion 56 of the restricting device 50 abuts against the front, left and right sides of the user's waist W, the left restricting portion 57 and the right restricting portion 58 respectively extend backward from the left and right sides of the user's waist W, and the suspension portion 59 extends frontward from the front side of the user's waist W, and therefore the body, two legs and two hands of the user U are not restricted and interfered by the restricting device 50 so as to move freely and naturally.

In order to improve the comfort during use, the retaining portion 56 of the restricting device 50 could affix a soft layer such as foam to an inner side thereof and/or making the retaining portion 56 have stretch elasticity. The left restricting portion 57 and the right restricting portion 58 both use the elastic band 53 to have stretch elasticity for improving the using comfort as well. With respect to the stretch elasticity of the two restricting portions 57, 58, the elastic band 53 could be replaced by a plurality of extension springs, or making the rear ends of the two restricting portions 57, 58 connect to the respective holding portions 24, 34 via the extension springs. However, even if the left restricting portion 57 and the right restricting portion 58 have no stretch elasticity, the restricting device 50 can still accomplish the retaining function.

As shown in FIG. 6, the retaining portion 56 of the restricting device 50 is preferably attached to the waist of the user to minimize negative effects on the user. Conversely, if the position of the retaining portion 56 is too high or too low, it might interfere with the movement of the use in natural motion or let the user feel uncomfortable (for example, too high position may limit forward action of the upper body while running, and too low position may interfere with leg lifting action). For the aforementioned exercise apparatus 100, the user is able to adjust the height of the retaining portion 56 of the restricting device 50 properly according to the height of the individual waist portion or other suitable location. The user can use the hook 54 at the front end of the suspension portion 59 to hook one of the horizontal rods 45 with respect to different heights on the front holding portion 43 so that the vertical height of the retaining portion 56 could be adjusted. In another embodiment of the present invention, the rear end of the left restricting portion 57 and the rear end of the right restricting portion 58 of the restricting device 50 are available for the user to adjust height in connection with the left rear holding portion 24 and the right rear holding portion 34 respectively. In regard to height adjustment of the front end and the rear end of the restricting device 50, the ends of the restricting device 50 could be selectively connected to the holding portions 43, 24, 34 at various heights, or allowing the holding portions 43, 24, 34 to adjust its height with respect to the platform. Incidentally, the restricting device of the present invention is not limited to be extended along the level of the user's waist from the front end to the rear end. For example, in another embodiment of the present invention, the front end of the suspension portion of the restricting device is connected to the front frame at a height higher than the height of the user's waist, correspondingly, the rear ends of the left and right restricting portions are connected to the left side frame and the right side frame at a height lower than the height of the user's waist. Therefore, the retaining potion of the restricting device between the front end and the rear ends could be located at a height corresponding to the user's waist.

Figure 7:
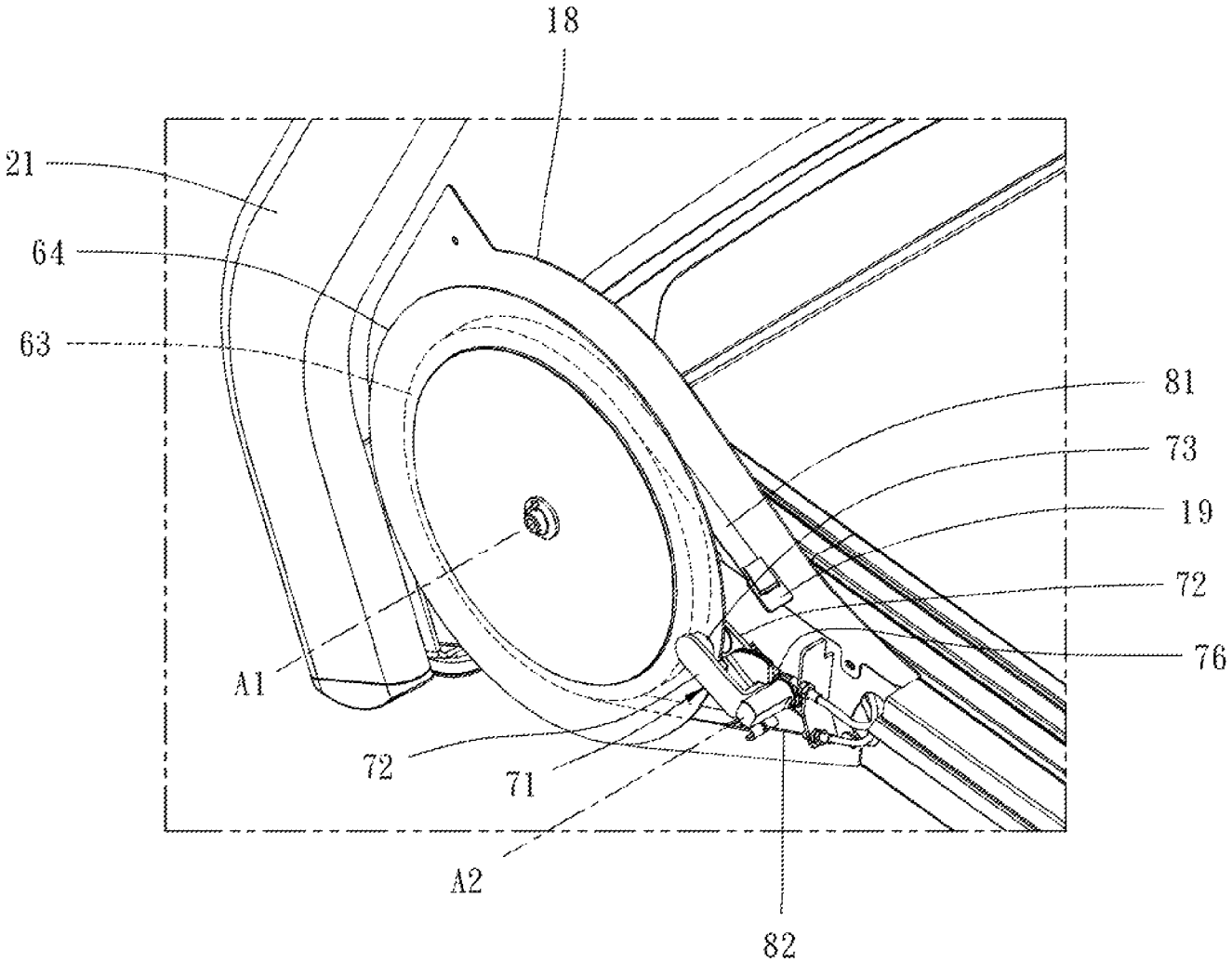
FIG. 7 is an enlarged view of a selected portion shown in FIG. 1, wherein parts of the outer shell are removed for showing the internal mechanism.
Figure 8:
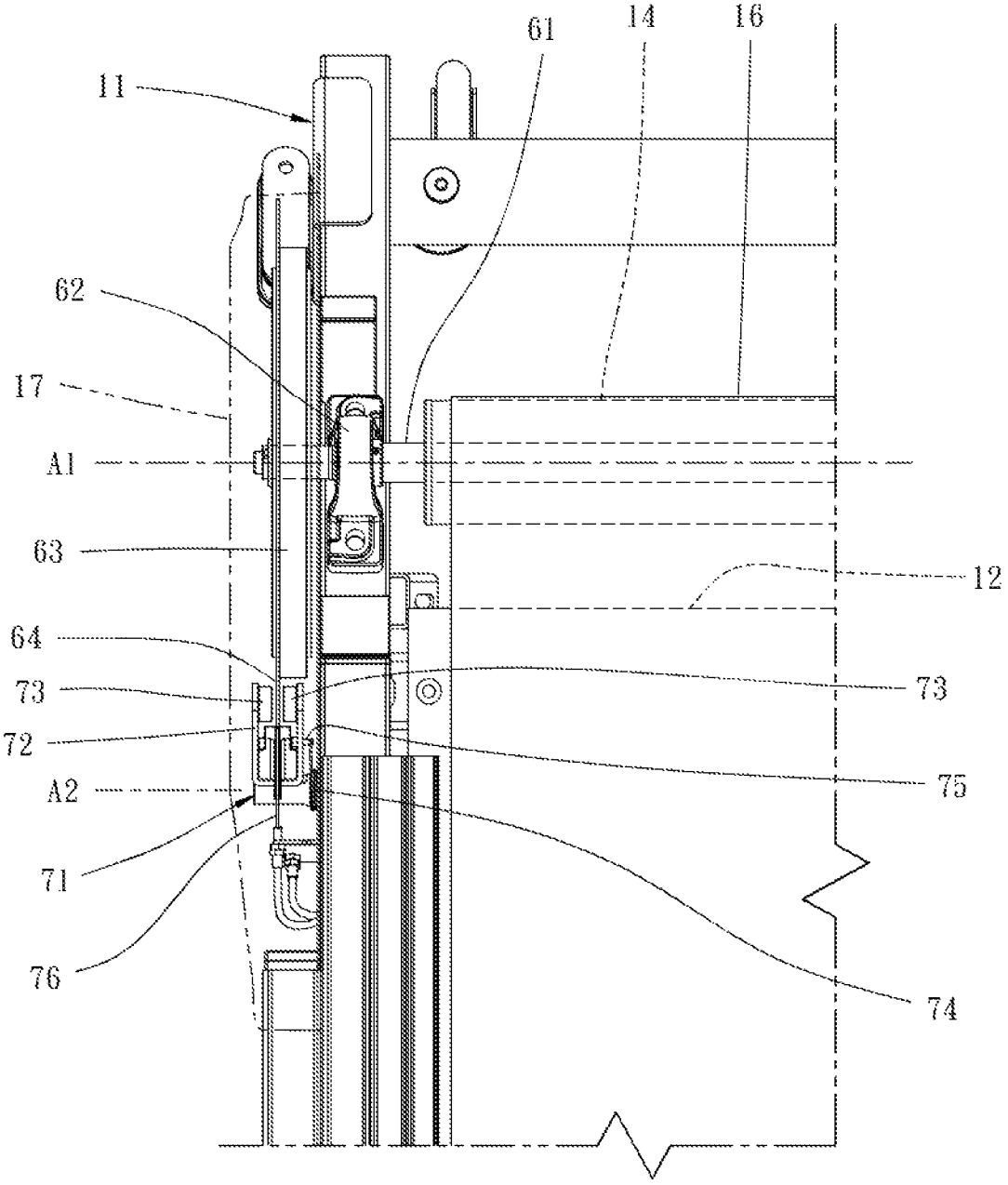
FIG. 8 is a top view for showing the left front area of the exercise apparatus in accordance with the preferred embodiment of the present invention, wherein parts of the outer shell are removed for showing the internal mechanism.

Like conventional non-electric treadmill, the exercise apparatus 100 also has a resistance device for adjusting the movement resistance of the belt 16. Referring to FIG. 4, FIG. 7 and FIG. 8, at the front end of the platform 10, the front roller 14 is coupled to a spindle 61 which passes through the axle center of the front roller 14, and two ends of the spindle 61 are pivotally mounted to the left and right sides of the support frame 11 via bearings 62, so that the front roller 14 could be in situ rotatable on the support frame 11 according to a first axis A1 in accordance with an axis of the spindle 61. The left end of the spindle 61 is projected from the respective bearing 62 and the left side of the support frame 11 and secured to the aforementioned flywheel 63. A metal disc 64 is coaxially attached to the outside of the flywheel 63. The outer diameter of the metal disc 64 is larger than that of the flywheel 63. In a back side of the flywheel 63 and the metal disc 64, a reluctance member 71 is pivotally mounted to the support frame 11 according to a second axis A2 in accordance with a lateral axial direction. The reluctance member 71 is rotatable between a first angular position and a second angular position with respect to the support frame 11 about the second axis A2 . The reluctance member 71 has two parallel pivot arms 72 extended from its pivot portion and being perpendicular to the second axis A2 . The two pivot arms 72 have two magnets 73 disposed at two opposite sides of the rear ends thereof. The two magnets 73 are spaced apart in a certain distance for allowing the metal disc 64 to pass through. A torsion spring 74 is mounted around the pivot portion of the reluctance member 71, as shown in FIG. 8. The torsion spring 74 has one end abutting against the support frame 11 and the other end abutting against a preset bolt 75 at an inner side of the reluctance member 71. The torsion spring 74 is configured to bias the reluctance member 71 toward the first angular position. A first steel cord 76 has one end connected to the reluctance member 71 and the other end connected to a controlling knob 77 at the top of the front post 31 of the right side frame 30. The controlling knob 77 (a conventional device, common in multi-speed bicycles) that can shorten or prolong the first steel cord 76 in stages to adjust the angle of the reluctance member 71 in stages. When the reluctance member 71 is located in the first angular position, the two magnets 73 are located at an inner side and an outer side of the metal disc 64 respectively, and an inner side of each magnet 73 faces to the metal disc 64. When the reluctance member 71 is located in the second angular position, the two magnets 73 are moved out beside the edge of the metal disc 64, and the inner side of each magnet 73 does not face the metal disc 64 substantially. Therefore, the reluctance member 71 and the metal disc 64 are defined as a magnetic resistance device, such as an eddy current brake (ECB) in the preferred embodiment of the present invention, namely, as the reluctance member 71 is controlled at various angles, the rotational resistance of the metal disc 64 (the flywheel 63, the front roller 14 as well) would be varied. For aesthetic and safety, the flywheel 63, the metal disc 64, the reluctance member 71 etc. are generally covered between a housing 17 (as shown in FIG. 1) and an inner board 18 (as shown in FIG. 7).

When the belt 16 is pushed by the user with his feet, the front roller 14 and the flywheel 63 will be rotated synchronously. The rotational inertia of the flywheel 63 provides an inertial force for the front roller 14 to make the belt 16 obtain additional pushing force and make the exercise smoother. The user could use the controlling knob 77 to adjust the rotational resistance of the metal disc 64 (and the flywheel 63, the front roller 14 as well) to make the belt 16 has a predetermined exercise resistance so as to meet requirements of walking, jogging or running exercises. For example, when the user feels that the belt 16 runs too fast/too slow, the user can turn the resistance up/down appropriately, or by increasing the resistance to enhance the exercise intensity for speeding up calorie consumption.

Figure 9:
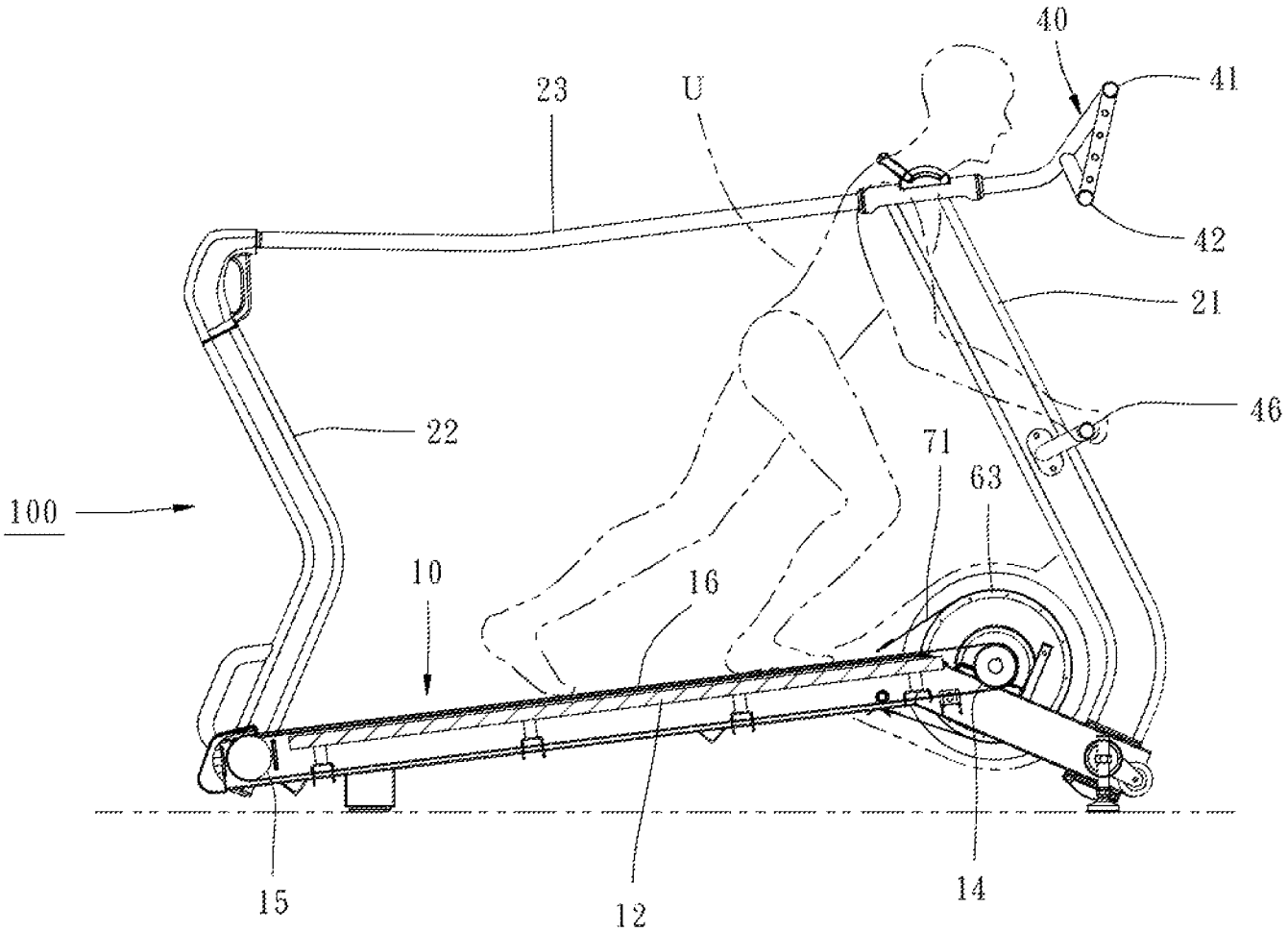
FIG. 9 is a side view of the exercise apparatus in accordance with the preferred embodiment of the present invention under a second operation mode for showing that the user executes a weight training.

As described above, the exercise apparatus 100 provides the user with aerobic exercise of walking, jogging or running, such mode of the exercise apparatus 100 is called "first operation mode" herein. In contrast, the exercise apparatus 100 also has a "second operation mode" providing the user with a weight training that simulates a motion of pushing a weight forward. The related designs and methods are described below. Referring to FIG. 7, in addition to the aforementioned eddy current resistance, the flywheel 63 also has another resisting source, that is, a brake band 81 tightens concentrically around most peripheral surface of the flywheel 63. The brake band 81 has one end secured to the support frame 11 (in the present embodiment, one end of the brake band 81 is secured to a retaining plate 19 on the inner board 18) and the other end of the brake band 81 is connected to one end of a second steel cord 82. The other end of the second steel cord 82 is connected to a lever controller 83 disposed on the top of the front post 21 of the left side frame 20. The lever controller 83 (a conventional device, common in multi-speed bicycles) that can shorten or prolong the second steel cord 82 in stages to adjust tightness/looseness of the brake band 81 around the flywheel 63 in stages, namely, applying different levels of friction resistance to the flywheel 63. When the user wants to perform the foregoing weight training, the user needs to detach the restricting device 50 that is connected among the left side frame 20, the right side frame 30 and the front frame 40 such that the restricting device 50 does not occupy the exercising space S. In the present embodiment, it makes the hook 54 at the front end of the second strap 52 be detached from the front holding portion 43 of the front frame 40, and then the second strap 52, together with the first strap 51, is rested on the rear side of the exercise apparatus 100. Under the situation that the left and right ends of the first strap 51 are still connected to the left rear holding portion 24 and the right rear holding portion 34, the first strap 51 is naturally drooped in connection between the left and right rear posts 22, 32, it does not interfere with the entrance G to the platform 10 for the user. In another embodiment of the present invention, the front end of the suspension portion 59, the rear end of the left restricting portion 57 and the rear end of the right restricting portion 58 of the restricting device 50 are all available for the user to detachably connect to the front holding portion 43, the left rear holding portion 24 and the right rear holding portion 34. Thus, the front end, the left rear end and the right rear end of the restricting device 50 could be detached completely, if necessary. Then, the first strap 51 and the second strap 52 could be placed beside the exercise apparatus 100 or other suitable position. As shown in FIG. 9 (the detached first strap 51 and the second strap 52 are not shown in the drawing), in the second operation mode, the user U is located in the exercising space S of the central location or the center more to the front, with two hands holding on a suitable position of the front frame 40, e.g. the upper rail 41, the lower rail 42 or a grip rod 46 connected between the left and the right front posts 21, 31 at a central height, adopting a low center of gravity position, as shown in FIG. 9, and pushing the belt 16 with two feet of the user U so as to simulates a motion of pushing a weight forward, such as push sled.

In general the largest resisting force generated by the eddy current brake (ECB) is still insufficient for being the resistance of the aforementioned weight training or fails to achieve the training effect effectively. In other words, the aforementioned weight training generally requires the use of the preceding friction resistance to make the belt 16 with sufficient high resistance. Therefore, when the user is going to start the weight training, the user could ignore the setting state of the eddy current brake (ECB) and adjust the friction resistance between the brake band 81 and the flywheel 63 by the lever controller 83 to make the belt 16 with appropriate resistance that the user has to push hard. In contrast, when the user wants to start walking, jogging or running, the user generally needs to check that the friction resistance has been adjusted to a lower level or almost released first to make the belt 16 could be driven by the natural motion of walking, jogging or running. If necessary, the user could use the controlling knob 77 to adjust the eddy current resistance between the reluctance member 71 and the metal disc 64, so that the belt 16 has appropriate resistance matching with personal desired velocity or movement difficulty. Under this arrangement, the exercise apparatus 100 has an eddy current resistance device which could be adjusted independently and a friction resistance device. For the weight training, the higher resistance could be achieved mainly by the friction resistance. Besides, it can provide a very large resistance to satisfy users with excellent physical ability or requirements of high strength training, such as athletes. In contrast, while walking, jogging or running, the relatively lower resistance could be achieved mainly by the eddy current resistance for slightly adjusting the resistance easily.

Figure 10:
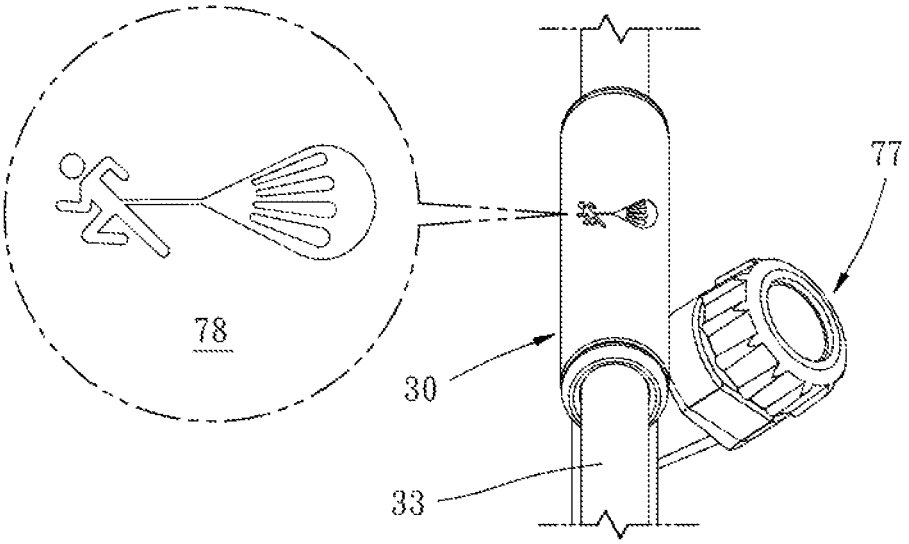
FIG. 10 shows the first control interface of the exercise apparatus in accordance with the preferred embodiment of the present invention.
Figure 11:
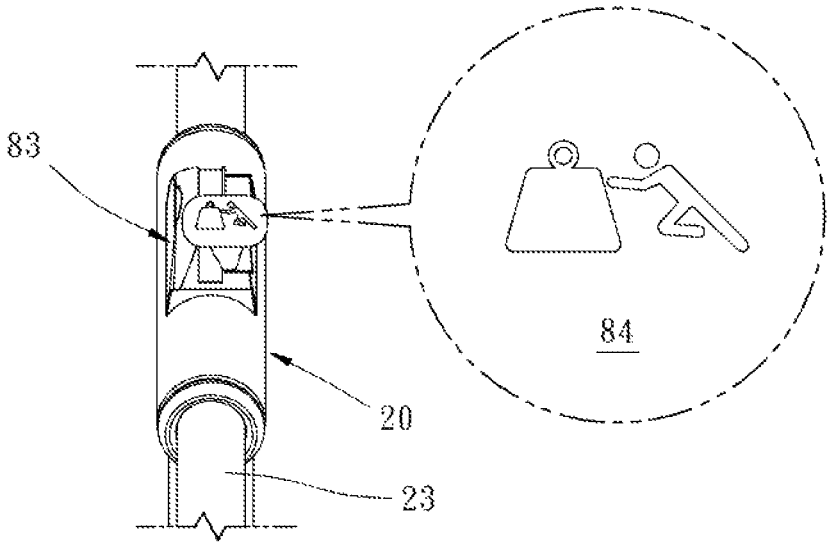
FIG. 11 shows the second control interface of the exercise apparatus in accordance with the preferred embodiment of the present invention.

In the aforementioned exercise apparatus 100, the controlling knob 77 for controlling the eddy current resistance device (or called first control interface hereafter) and the lever controller 83 for controlling the friction resistance device (or called second control interface hereafter) are respectively mounted to the right side frame 30 and the left side frame 20 and disposed at suitable locations such that the user could reach his hands to operate. Additionally, in order to enable users to identify which control interface is used to control the relatively lower resistance for performing walking, jogging or running and to identify which control interface is used to control the relative higher resistance for performing the weight training. In the preferred embodiment of the present invention, the two control interfaces 77, 83 are respectively labeled with different symbols that the user could distinguish them directly. Specifically, as shown in FIG. 10, the right side frame 30 has a first symbol 78 defined on a portion corresponding to the top of the front post 31, namely the first symbol 78 is arranged beside the controlling knob 77. The first symbol 78 is displayed on the right side frame 30 by means of coating printing, stamping, stickers, dual-color injection, embossing, intaglio, etc. The first symbol 78 represents a figure with a running person dragging a parachute behind him, which symbolizes that the user must overcome a relatively lower resistance while performing walking, jogging or running (or called first type exercises hereafter). On the other hand, as shown in FIG. 11, the lever controller 83 has a second symbol 84 defined on a top plane of a lever thereof by means of coating printing, stamping, stickers, dual-color injection, embossing, intaglio, etc. The second symbol 84 represents a figure with a person reached his hands to push a weight (exaggerative) forwards, which symbolizes that the user must overcome a relative higher resistance while performing the weight training (or called second type exercises hereafter). The first symbol 78 shows an identifiable human figure corresponding to an exercise posture as performing the first type exercise (represented by the running posture), and the second symbol 84 shows another identifiable human figure corresponding to another exercise posture as performing the second type exercise. In the meanwhile, the images of the parachute and the weight (exaggerative) matched with the human postures would make people associate the first type exercise with the relatively lower resistance and associate the second type exercise with the relative higher resistance. Therefore, under the first control interface 77 and the second control interface 83 respectively labeled with the first symbol 78 and the second symbol 84, the user is able to quickly and correctly identify the respective purposes of the two control interfaces 77, 83. In other words, no matter the user is performing the first type exercise of walking, jogging or running under the first operation mode, or is performing the second type exercise of simulating a training of pushing a weight forward under the second operation mode, the user could operate the correct control interface 77, 83 directly and adjust the required resistance of the endless belt for the exercise at the time.

Figure 10A:
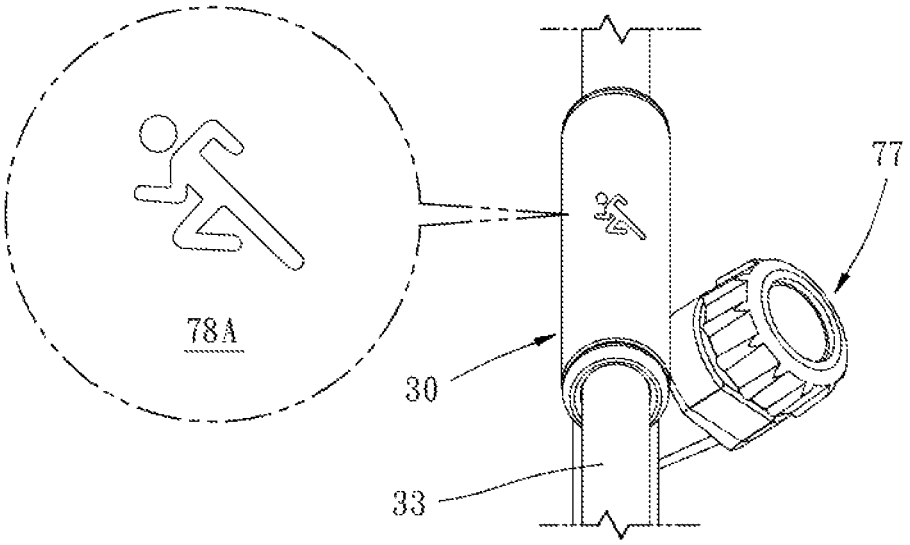
FIG. 10A is similar to FIG. 10, showing the first control interface with different illustration.
Figure 11A:
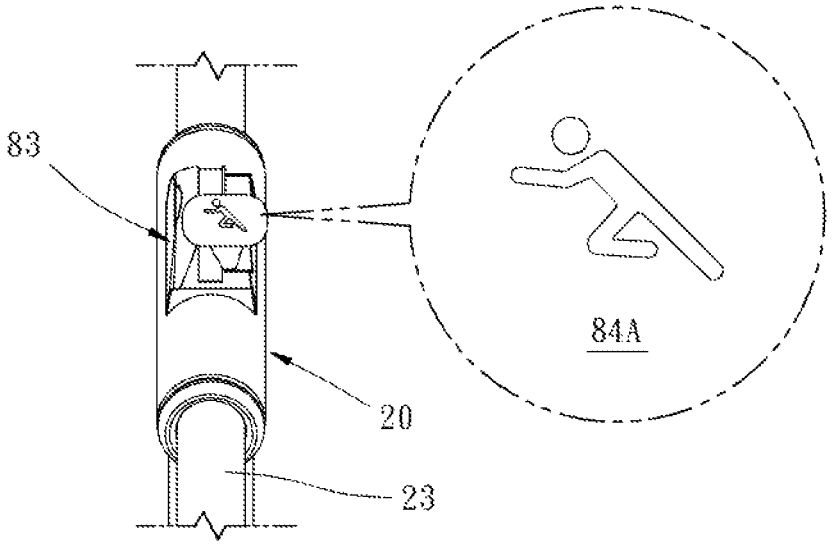
FIG. 11A and FIG. 11B are similar to FIG. 11, showing the second control interface with different illustration.

FIG. 10A and FIG. 11A illustrate another embodiment of the present invention, which respectively show the more simple expressions of the first symbol and the second symbol, that is the first symbol 78A only has a posture as a human figure for performing the first type exercise (represented by the running posture), and the second symbol 84A only has another posture as a human figure for performing the second type exercise. It allows the user to identify the respective purposes of the first control interface 77 and the second control interface 83.

In actual operation conditions, if the lever of the lever controller 83 is pushed to the more forward position, the second steel cord 82 connected between the lever controller 83 and the brake band 81 of the friction resistance device would be tightened simultaneously so as to make the friction resistance device apply more drag force to the flywheel 63. On the contrary, if the lever of the lever controller 83 is pulled to the more backward position, the friction resistance device would apply less drag force to the flywheel 63 (this is a general application of a conventional device, and the technical details are omitted). The lever controller 83 shown in FIGS. 11 and 11A has a plurality of scale marks spaced a distance apart on the arc path with respect to the adjustable range of the lever and a plurality of numerals corresponding to the scales (not shown). The numerals are increased progressively from back to front along the adjusting path of the lever so as to indicate the corresponding resistance level according to the location of the lever. For example, in the present embodiment, the friction resistance can be adjusted by the lever controller 83 with eight adjustments. Thus the rearmost scale mark of the adjusting path of the lever is labeled "1", the forward scale mark is labeled "2", and so on, and the foremost scale mark is labeled "8". In contrast, the eddy current resistance can be adjusted by the controlling knob 77 with eleven adjustments. The controlling knob 77 shown in FIGS. 10 and 10A is labeled "1" to "11" spaced a distance apart on the periphery of the controlling knob 77 (not shown). When the controlling knob 77 is turned to a specific angle within the adjustable range, a specific numeral on the periphery of the controlling knob 77 is aligned with a reference symbol (not shown) on a base for indicating the corresponding resistance level according to the angular position of the controlling knob 77.

Figure 10B:
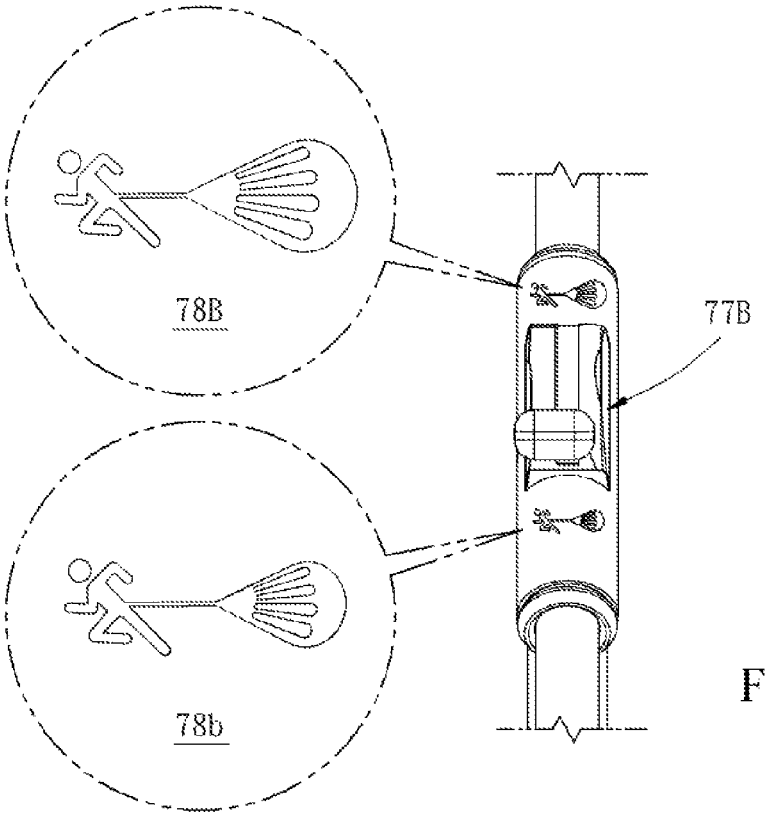
FIG. 10B illustrates another embodiment of the first control interface.
Figure 11B:
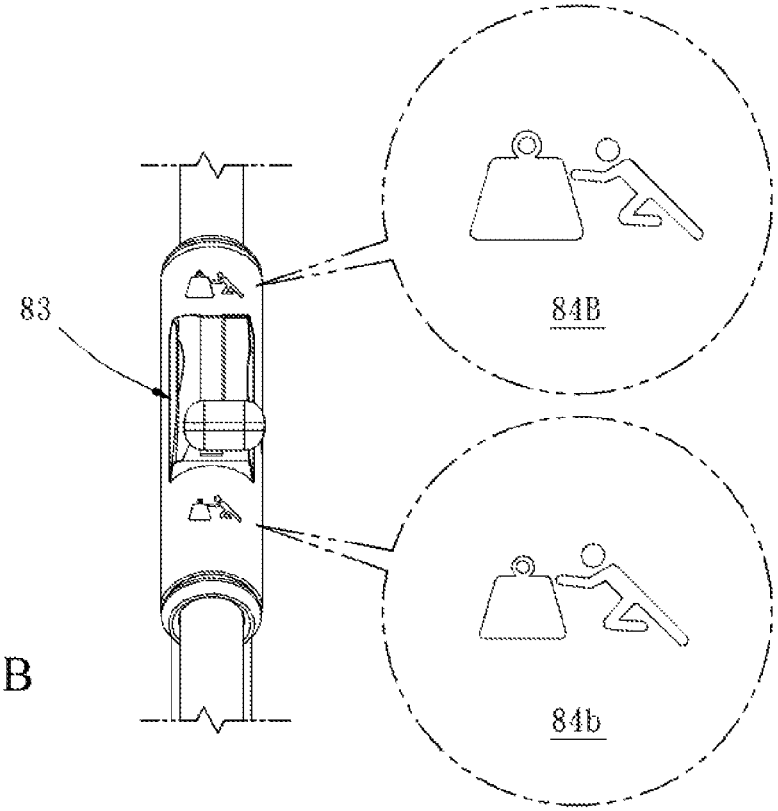

FIG. 11B shows that the lever controller (the second control interface) 83 adopts another representing way, namely, in this embodiment, the left side frame 20 is labeled with two second symbols 84B, 84*b* respectively defined at the front position and the rear position with respect to the lever controller 83. Both the two second symbols 84B, 84*b* resemble the second symbol 84 shown in FIG. 11, representing a figure with a person reached his hands to push a weight forward. It is noteworthy that the weight figure of the second symbol 84B at the front position (corresponding to the direction of increasing the drag force) is relatively large, representing a greater resistance. In contrast, the other weight figure of the second symbol 84*b* at the rear position (corresponding to the direction of decreasing the drag force) is relatively small, representing a lower resistance. Base on the same technical idea, as shown in FIG. 10B, the first control interface is able to adopt another lever controller 77B as well, and is labeled two first symbols 78B, 78*b* respectively defined at the front position and the rear position with respect to the lever controller 77B. Both the two first symbols 78B, 78*b* represent a figure with a running person dragging a parachute. The parachute figure of the first symbol 78B at the front position is relatively large, representing a greater resistance. In contrast, the other parachute figure of the first symbol 78*b* at the rear position is relatively small, representing a lower resistance. Of course, the same technical idea is applicable to a controlling knob or any other controlling device with two opposite operational direction. With a controlling knob as an example, it can be labeled a relatively large parachute/weight figure corresponding to a rotational direction of increasing the drag force (as 78B, 84B), and be labeled a relative small parachute/weight figure corresponding to a rotational direction of decreasing the drag force (as 78*b*, 84*b*). Under this representation, the user could not only directly identify the respective purposes of the first control interface and the second control interface, but also directly identify operating directions of increasing or decreasing the drag force in the same control interface so as to enhance the friendliness of the control interface and to reduce operating errors.

Although the control interfaces of the aforementioned embodiments are designed to control the resistance device with purely mechanical means, it could also be achieved by electronic circuits and electronic control means. For instance, in another embodiment of the present invention (not shown), the reluctance member 71 of the eddy current resistance device could be modified to be driven by an electronic motor to control its deflection angle. Correspondingly, the first control interface is replaced by an electronic control panel electronically connected to the electronic motor, having two opposite pressed keys for allowing the user to operate to increase or decrease the drag force (note: this is a general application of a conventional device, and the technical details are omitted). According to the technical idea disclosed in the preceding section, the first interface could be labeled the figures 78B, 78*b* as shown in FIG. 10B on the two pressed keys or beside them for the user to identification.

According to one aspect of the present invention, the exercise apparatus provides two operation modes for allowing the user to choose to perform the first type exercise (such as walking, jogging or running mentioned before) under the first operation mode, or choose to perform the second type exercise (such as simulating the training of pushing a weight forward mentioned before) under the second operation mode. The exercising movements of the first type exercise and the second type exercise differ from each other. The exercise apparatus comprises a frame, and a moving member (e.g. the aforementioned flywheel 63) movably mounted to the frame. The first type exercise and the second type exercise shall power the moving member. A first resistance device (e.g. a contactless resistance device, such as the aforementioned eddy current resistance device) is controllable to apply a first drag force to the moving member. A second type resistance device (e.g. a contact resistance device, such as the aforementioned friction resistance device) is controllable to apply a second drag force to the moving member. The second drag force generated by the second resistance device is higher than the first drag force generated by the first resistance device. A first control interface is connected to the first resistance device, for allowing the user to manually control the first resistance device to increase or decrease the first drag force applied to the moving member. The first control interface has at least one first symbol including a human figure showing a posture as performing the first type exercise. And a second control interface is connected to the second resistance device, for allowing the user to manually control the second resistance device to increase or decrease the second drag force applied to the moving member. The second control interface has at least one second symbol including a human figure showing a posture as performing the second type exercise. Specifically, the resistance of the moving member for performing the second type exercise is higher than the resistance for performing the first type exercise.

Under this arrangement, the exercise apparatus provide a choice for the user to choose one aerobic exercise such as walking, jogging running, or simulating weigh training for pushing a weight forward. Moreover, it could easily obtain appropriate resistance whether performing the aerobic exercise or the weight training. The exercise apparatus of the present invention includes: a platform having a front roller, a rear roller and an endless belt mounted around above two rollers for allowing the user to perform walking, jogging or running on the belt, such exercises would make the belt be revolved; a flywheel coaxially connected to the front roller. A friction resistance device is coupled to the flywheel for allowing the user to manually control the rotational resistance of the flywheel and the front roller. An eddy current resistance device is coupled to the flywheel for allowing the user to manually control the rotational resistance of the flywheel and the front roller. A front frame mounted on a front end of the platform, and having at least one holding portion for the user to grasp.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus, comprising:

a platform having a front roller, a rear roller and an endless belt mounted around the front roller and the rear roller for allowing a user to perform walking, jogging or running exercises on the belt;

a flywheel coupled to one of the two rollers;

a friction resistance device coupled to the flywheel for being controlled by the user to adjust rotational resistance of the flywheel;

a magnetic resistance device coupled to the flywheel for being controlled by the user to adjust the rotational resistance of the flywheel; and a front frame mounted at a front side of the platform, and having at least one holding portion for being held by the user.

2. An exercise apparatus, comprising:

a platform having a support frame resting on a ground surface, a front roller and a rear roller rotationally mounted to the support frame, an endless belt mounted around the front roller and the rear roller, and a flywheel;

a frame body secured on the support frame, the frame body comprising a front frame, the front frame having at least one holding portion for being held by a user;

a magnetic resistance device for applying a first drag force to the flywheel;

a friction resistance device for applying a second drag force to the flywheel, wherein the second drag force generated by the friction resistance device is higher than the first drag force generated by the magnetic resistance device;

a first control interface disposed on the frame body for allowing the user to control the magnetic resistance device to increase or decrease the first drag force applied to the flywheel; and a second control interface disposed on the frame body for allowing the user to control the friction resistance device to increase or decrease the second drag force applied to the flywheel;

wherein the exercise apparatus is provided for the user to selectively perform a first type exercise as jogging, running or perform a second type exercise in which the user grasps a holding portion of the front frame and pushes the endless belt backwards, the second drag force applied to the flywheel when performing the second type exercise.

3. The exercise apparatus as claimed in claim 2, wherein the first control interface has at least one first symbol that includes a human figure showing a posture that is associated with the first drag force; and the second control interface has at least one second symbol which includes another human figure showing a posture that is associated with the second drag force, the second symbol being different from the first symbol.

4. The exercise apparatus as claimed in claim 3, wherein the first symbol represents a figure with a running person dragging a parachute.

5. The exercise apparatus as claimed in claim 3, wherein the second symbol represents a figure with a person pushing a weight forward.

6. The exercise apparatus as claimed in claim 3, wherein the first control interface is labeled with two first symbols corresponding with increasing and decreasing the first drag force, both the two first symbols representing a figure with a running person dragging a parachute, the parachute of one first symbol corresponding to the direction of increasing the first drag force and being larger than the parachute of the other first symbol corresponding to the direction of decreasing the first drag force; the second control interface is labeled with two second symbols corresponding with increasing and decreasing the second drag force, both the two second symbols representing a figure with a person pushing a weight forward, the weight of one second symbol corresponding to the direction of increasing the second drag force and being larger than the weight of the other second symbol corresponding to the direction of decreasing the second drag force.

7. An exercise apparatus for allowing a user to choose to perform a first type exercise or a second type exercise, the exercise apparatus comprising:

a frame;

a moving member movably mounted to the frame, and being powered by the user performing the first type exercise or the second type exercise;

a first resistance device for applying a first drag force to the moving member; a second resistance device for applying a second drag force to the moving member, wherein the second drag force generated by the second resistance device is higher than the first drag force generated by the first resistance device;

a first control interface connected to the first resistance device, for allowing the user to control the first resistance device to increase or decrease the first drag force applied to the moving member, the first control interface having at least one first symbol including a human figure showing a posture that is associated with the first drag force; and a second control interface connected to the second resistance device, for allowing the user to control the second resistance device to increase or decrease the second drag force applied to the moving member, the second control interface having at least one second symbol including a human figure showing a posture that is associated with the second drag force, the second symbol being different from the first symbol;

wherein exercise resistance for performing the second type exercise is higher than the exercise resistance for performing the first type exercise.

8. The exercise apparatus as claimed in claim 7, wherein the moving member comprises a flywheel, the first resistance device comprises an eddy current brake, and the second resistance device comprises a friction brake.

9. The exercise apparatus as claimed in claim 7, further comprising a front roller, a rear roller rotationally mounted to the frame, an endless belt mounted around the two rollers, and a front frame mounted on the frame, the front frame having at least one holding portion for being held by the user; wherein the first type exercise corresponds to exercises as jogging or running, and the second type exercise corresponds to a weight training in which the user grasps the holding portion for simulating a motion of pushing a weight forward.

10. The exercise apparatus as claimed in claim 9, wherein the first symbol represents a figure with a running person dragging a parachute, and the second symbol represents a figure with a person with hands pushing a weight forward.

* * * * *